US009943976B2

(12) United States Patent
Schütz

(10) Patent No.: US 9,943,976 B2
(45) Date of Patent: Apr. 17, 2018

(54) DEVICE FOR PRODUCING ADHESIVE LABELS

(71) Applicant: CEWE Stiftung & Co. KGaA, Oldenburg (DE)

(72) Inventor: Peter Schütz, Varel (DE)

(73) Assignee: CEWE Stiftung & Co. KGaA, Oldenburg (DE)

( * ) Notice: Subject to any disclaimer, the term of this patent is extended or adjusted under 35 U.S.C. 154(b) by 0 days.

(21) Appl. No.: 15/528,486

(22) PCT Filed: Nov. 19, 2015

(86) PCT No.: PCT/EP2015/077168

§ 371 (c)(1),
(2) Date: May 19, 2017

(87) PCT Pub. No.: WO2016/079273

PCT Pub. Date: May 26, 2016

(65) Prior Publication Data

US 2017/0252938 A1 Sep. 7, 2017

(30) Foreign Application Priority Data

Nov. 19, 2014 (DE) ..... 10 2014 223 628
Nov. 19, 2014 (DE) ..... 20 2014 009 169 U
Jan. 5, 2015 (DE) ..... 10 2015 200 033

(51) Int. Cl.
*B41J 11/66* (2006.01)
*B41J 11/70* (2006.01)
(Continued)

(52) U.S. Cl.
CPC ..... *B26D 5/32* (2013.01); *B26D 1/105* (2013.01); *B26D 5/34* (2013.01); *B26F 1/382* (2013.01);
(Continued)

(58) Field of Classification Search
CPC ..... B41J 11/663; B41J 11/703; B41J 11/70; B41J 3/4075; B41J 11/66; B41J 11/666;
(Continued)

(56) References Cited

U.S. PATENT DOCUMENTS 6,209,435 B1 * 4/2001 Miyazaki ..... B26D 3/085 83/300
6,408,132 B1 6/2002 Ishikawa
(Continued)

FOREIGN PATENT DOCUMENTS

EP 0947341 10/1999
JP 2-196278 8/1990
(Continued)

OTHER PUBLICATIONS

International Search Report and Written Opinion of the International Searching Authority dated Mar. 14, 2016 (+English translation), in International Patent Application No. PCT/EP15/77168, 20 pages.

*Primary Examiner* — Huan Tran
(74) *Attorney, Agent, or Firm* — Ellen M. Bierman; Lowe Graham Jones PLLC

(57) ABSTRACT

This disclosure relates to a device for producing adhesive labels, in particular in a self-service area, for example of a drug store. The device comprises a printer for printing a printing pattern based on user inputs onto an adhesive film, a cutting apparatus for cutting the adhesive film along a specified cutting pattern which can be selected by a user, and a transferring apparatus for automatically transferring the printed adhesive film from the printer to the cutting apparatus, wherein the transferring apparatus comprises a first moving unit for automatically moving the printed adhesive film in a forward direction from the printer to the cutting apparatus. A control apparatus controls the automatic trans-
(Continued)

fer of the printed adhesive film from the printer to the cutting apparatus.

14 Claims, 9 Drawing Sheets

(51) Int. Cl.

| | |
|---|---|
| ***B26D 5/32*** | (2006.01) |
| ***B26D 1/10*** | (2006.01) |
| ***B26D 5/34*** | (2006.01) |
| ***B26F 1/38*** | (2006.01) |
| ***B65H 35/00*** | (2006.01) |
| ***B41J 3/407*** | (2006.01) |
| *B26D 5/00* | (2006.01) |

(52) U.S. Cl.
CPC ..... *B41J 3/4075* (2013.01); *B41J 11/66* (2013.01); *B41J 11/70* (2013.01); *B65H 35/0006* (2013.01); *B26D 2005/002* (2013.01); *B65H 2301/515* (2013.01); *B65H 2403/942* (2013.01); *B65H 2701/192* (2013.01)

(58) Field of Classification Search
CPC .... B26D 5/005; B26D 5/34; B26D 2005/002; B26D 3/085; B26D 5/00; B26D 5/08; B26D 9/00; B26F 1/3806; B26F 1/382
See application file for complete search history.

(56) References Cited

U.S. PATENT DOCUMENTS

| | | | | |
|---|---|---|---|---|
| 9,596,376 | B2 * | 3/2017 | Sakahara | H04N 1/2154 |
| 2010/0119282 | A1 * | 5/2010 | Olsen | B41J 3/407 400/621 |
| 2014/0126947 | A1 | 5/2014 | Sago et al. | |
| 2017/0253055 | A1 * | 9/2017 | Schutz | B41J 11/663 |

FOREIGN PATENT DOCUMENTS

| | | |
|---|---|---|
| JP | 11-320993 | 11/1999 |
| WO | 2010/009354 | 1/2010 |

* cited by examiner

DEVICE FOR PRODUCING ADHESIVE LABELS

CROSS-REFERENCE TO RELATED APPLICATIONS

This application is a U.S. national phase of International Patent Application No. PCT/EP2015/077168 filed Nov. 19, 2015; which claims priority from Germany Patent Application Nos. 102014223628.2 filed Nov. 19, 2014; 202014009169.2 filed Nov. 19, 2017; and 102015200033.8 filed Jan. 5, 2015, the contents of which applications are hereby incorporated by reference in their entireties.

TECHNICAL FIELD

The invention relates to a device, a method and a computer program for producing adhesive labels.

BACKGROUND

Nowadays, a user can select a product on the Internet, for example a shower gel or a sun cream, and design a pattern to be applied to the product in order to personalize it. The selected product is sent along with the designed pattern to a printing works, where the pattern designed by the user is printed onto an adhesive film. A printing works employee removes the printed adhesive film from the printer and places it into a cutting apparatus. The employee also aligns the printed adhesive film in the cutting apparatus before the cutting apparatus cuts along the outline of the printed pattern cutting in order to produce an adhesive label. The employee then sticks the label thus produced onto the selected products, after which the selected product is sent to the user by post.

The adhesive labels may have cutting errors, which are due, in particular, to the required adjustment by the employee, as a result of which the quality of the label may be reduced.

BRIEF DESCRIPTION OF THE DRAWINGS

Embodiments shall now be described with reference to the attached Figures, in which.

DETAILED DESCRIPTION

Figure 1:
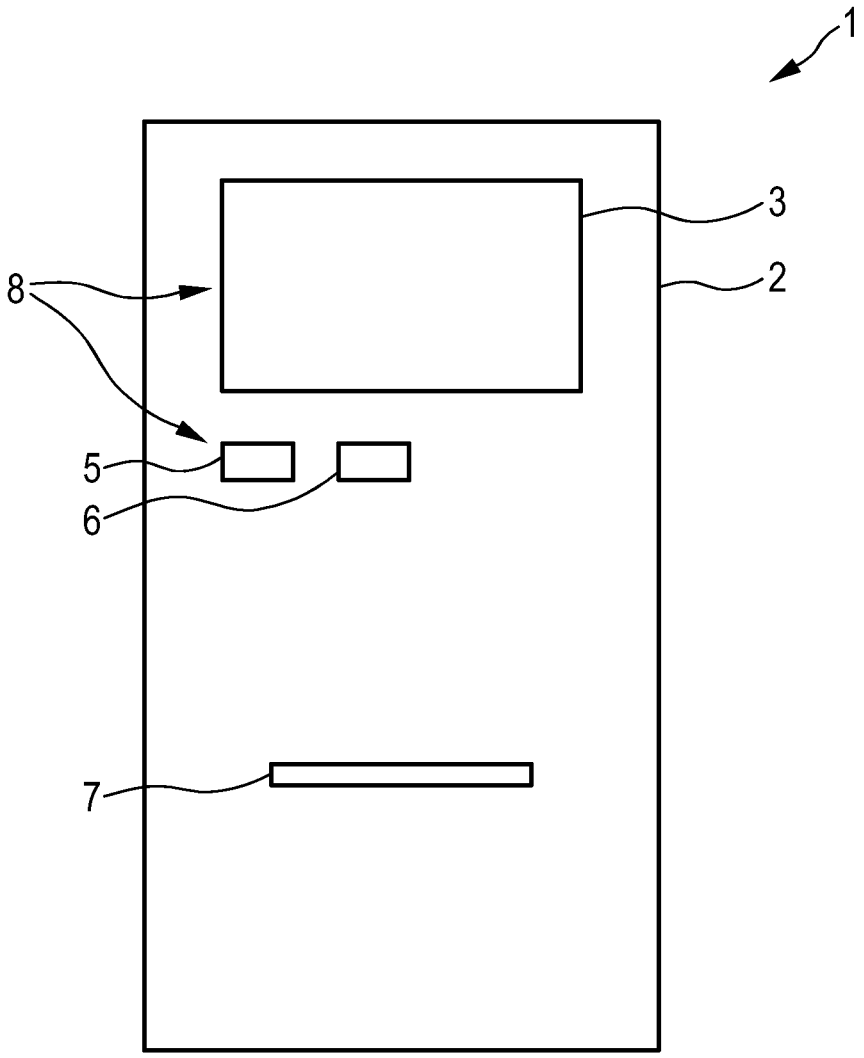
FIG. 1 shows, in schematic form and by way of example, an embodiment of a device for producing adhesive labels.

Embodiments described herein provide a device, a method and a computer program for producing adhesive labels, which may improve the quality of the adhesive labels thus produced.

This goal is achieved by a device for producing adhesive labels, comprising the following components:

an input device which is adapted to allow the user to enter inputs, a pattern generating means for generating a pattern on the basis of the user inputs, wherein the pattern comprises a cutting pattern and a printing pattern within the cutting pattern, a printer for printing the printing pattern onto an adhesive film, a cutting apparatus for cutting the adhesive film along the cutting pattern, a transferring apparatus for automatically transferring the printed adhesive film from the printer to the cutting apparatus, wherein the transferring apparatus comprises a first moving unit for automatically moving the printed adhesive film in a forward direction from the printer to the cutting apparatus, and a control apparatus for controlling the automatic transfer of the printed adhesive film from the printer to the cutting apparatus.

The device thus comprises a printer, a transferring apparatus and a cutting apparatus, wherein the printer prints the adhesive film, after which the transferring apparatus guides the adhesive film automatically to the cutting apparatus, in which the adhesive film is cut along the cutting pattern to produce the adhesive label. Since the orientation of the adhesive film inside the cutting apparatus is known, due to the printed adhesive film being transferred automatically from the printer to the cutting apparatus, manual adjustment of the adhesive film inside the cutting apparatus is not absolutely necessary, which can result in reduced susceptibility to error, that is, in less likelihood of inaccurate cuts, and thus in adhesive labels of better quality.

The input device, the pattern generating means, the printer, the transferring apparatus and the cutting apparatus are also integrated in the same device for producing adhesive labels. The user can therefore input data directly in a self-service area of a drug store, for example, after which the pattern generating means generates the pattern on the basis of the user inputs, the printer prints the generated pattern onto the adhesive film, the printed adhesive film is guided automatically by means of the transferring apparatus to the cutting apparatus and the cutting apparatus cuts the adhesive film along the cutting pattern to produce the adhesive label directly in the self-service area. The device can therefore produce a personalized adhesive label in a relatively fast process using user inputs.

The printer and the cutting apparatus are preferably units that are spaced apart from each other. They are preferably not integrated with each other. The transferring apparatus is preferably located between the printer and the cutting apparatus, so that the transferring apparatus can transfer a printed adhesive film automatically from the printer to the cutting apparatus. The transferring apparatus is preferably integrated with neither the printer nor the cutting apparatus. In particular, the cutting apparatus and the transferring apparatus are preferably not integrated with the printer and are therefore not part of the printer.

In the following, the direction from the printer via the transferring apparatus to the cutting apparatus is referred to as the forward direction. The printer, the transferring apparatus and the cutting apparatus are preferably arranged in such a way that the adhesive film can be moved linearly in a forward direction from the printer to the cutting apparatus via the transferring apparatus, wherein the transferring apparatus is adapted to move the printed adhesive film in a forward direction by performing a translational movement only, without rotating the adhesive film. Since the transferring apparatus moves the printed adhesive film by performing a translational movement only, without rotating the adhesive film, the likelihood of incorrect adjustment of the printed adhesive film within the cutting apparatus and therefore of inaccurate cuts is further reduced. In order to further improve this cutting accuracy, the pattern generating means may be adapted to mark the pattern with an orientation marking so that the printed adhesive film has an orientation marking, the cutting apparatus having a detection unit for detecting the orientation marking on the printed adhesive film, and may be adapted to optimize the orientation of the printed adhesive film inside the cutting apparatus, on the basis of the detected orientation marking, before cutting is carried out. In particular, a second moving unit of the cutting apparatus for moving the printed adhesive film inside the cutting apparatus in a forward and a backward direction, and a cutting unit of the cutting apparatus, which can be moved laterally in relation thereto and in particular orthogonally in relation thereto, can be controlled in such a way that, before cutting is carried out, the position of the cutting unit relative to the orientation marking corresponds even better to a predefined position. In this way, the cutting accuracy can be further improved.

Due to the printed adhesive film being fed automatically and relatively accurately from the printer to the cutting apparatus, automatic repositioning based on a plurality of orientation markings on the printed adhesive film does not generally provide any further advantage as far as accuracy is concerned. For that reason, such repositioning is carried out in a preferred embodiment purely on the basis of a single orientation marking. Several orientation markings could be used in other embodiments, however, or repositioning could be omitted, in which case the printed adhesive film could have no orientation marking. The orientation marking preferably comprises an L-shaped structure which is preferably arranged in a corner area of the printed adhesive film.

The detection unit may have a light source, in particular a laser, for irradiating the printed adhesive film, and a detector for detecting the light reflected from the printed adhesive film, wherein the detection unit may be adapted to detect the orientation marking on the basis of the reflected light, and wherein the control apparatus may be adapted not to activate the laser until the second moving unit is activated. In this way, the energy consumption of the apparatus can be reduced.

The control unit is preferably configured to control the second moving unit and the cutting unit so that the printed adhesive film and the cutting unit are moved in such a way that the adhesive film is cut along the generated cutting pattern.

The control apparatus is preferably adapted to control the first and the second moving units in such a way that only the first moving unit is initially activated to move the printed adhesive film to the second moving unit, wherein both moving units are then activated in such a way that the two moving units synchronously move the printed adhesive film further into the cutting apparatus. More particularly, the printed adhesive film is moved to a short distance in front of the second moving unit, and it is not until then that the two moving units are moved synchronously in order to guide the printed adhesive film into the cutting apparatus. Due to the first moving unit initially moving the printed adhesive film to a short distance in front of the second moving unit, and to the fact that it is not until that state has been reached, in which the printed adhesive film is located a short distance in front of the moving unit, that both the moving units are moved synchronously to guide the printed adhesive film into the cutting apparatus, it is possible to prevent the first moving unit from pressing the printed adhesive film against the second moving unit, as a result of which it is possible to prevent the printed adhesive film from being curled, folded and/or twisted. Since the second moving unit is also activated only when the state described above has been reached, in which the printed adhesive film is located directly in front of the second moving unit, the second moving unit is not activated unnecessarily, with the result that energy consumption can be reduced.

It is preferable that the transferring apparatus also comprises a measurement unit for measuring the distance the printed adhesive film is moved in the direction of the cutting apparatus by means of the first moving unit, the control apparatus being adapted to control the first moving unit in such a way that the printed adhesive film is moved forward in the direction of the cutting apparatus until the measured distance indicates that the printed adhesive film has been moved to the second moving unit. By using the measurement unit, it is possible to ensure by relatively simple technical means that the first moving unit initially moves the printed adhesive film only as far as a short distance in front of the second moving unit.

The measurement unit is also preferably adapted to measure the distance that the printer has guided the printed adhesive film into the transferring apparatus, wherein the control apparatus is adapted to control the first moving unit in such a way that the printed adhesive film is moved forward in the direction of the cutting apparatus until the total measured distance indicates that the printed adhesive film has been moved to the second moving unit. By additionally taking into account the distance which the printer has guided the printed adhesive film into the transferring apparatus, it is possible for the printed adhesive film to be moved even more accurately by means of the first moving unit such that the printed adhesive film is initially only moved as far as a short distance in front of the second moving unit.

The first moving unit preferably has motor-driven rolls that freewheel in a forward direction, the measurement unit being adapted to measure a passive freewheeling rotation of the rolls when the printed adhesive film is moved from the printer into the transferring apparatus, in order to measure the distance that the printer has moved the printed adhesive film into the transferring apparatus. Since the first moving unit has motor-driven rolls that freewheel in the forward direction, the printer can move the printed adhesive film into the first moving unit, that is, to the motor-driven rolls of the first moving unit, without running the risk of the printed adhesive film being curled, folded and/or twisted. This further reduces the likelihood of the printed adhesive film being imprecisely aligned in the cutting apparatus, and hence of it being inaccurately cut. Measuring distance on the basis of rotation can also be used to measure the distance by which the first moving unit has moved the printed adhesive film in the direction of the cutting apparatus. This allows the device to be more compact in design.

The second moving unit preferably comprises motor-driven rolls for moving the printed adhesive film into the cutting apparatus, wherein the motor-driven rolls do not freewheel. The transferring apparatus also preferably comprises a guide unit which is adjusted to guide the printed adhesive film past the first moving unit when the second moving unit moves the printed adhesive film backward in the direction of the transferring apparatus. The guide unit may be adjusted, in particular, to guide the printed adhesive film underneath the first moving unit when the second moving unit moves the printed adhesive film backward in the direction of the transferring apparatus. By guiding the printed adhesive film past the first moving unit, it is possible to ensure that the printed adhesive film is not curled, folded and/or twisted when it is being cut in the cutting apparatus, while the printed adhesive film is generally being moved backward in the direction of the first moving unit. In this way, it is also possible to ensure that the printed adhesive film also remains exactly aligned during the cutting operation inside the cutting apparatus, as a result of which the cutting accuracy can be improved still further.

The transferring apparatus may have an adhesive film detection unit for detecting when the printed adhesive film is fed to the transferring apparatus, wherein the control apparatus can be adapted to control the first moving unit in such a way that the first moving unit does not move the printed adhesive film in the direction of the cutting apparatus until a predefined period of time has expired since detection of the adhesive film being fed. The printer may be adapted to print the printing pattern onto a printed area of a web of adhesive film, to cut out said printed area and to feed the cut-out printed area as a printed adhesive film to the transferring apparatus. The predefined period of time is preferably at least so long that the cutting operation of the printer is completed when the first moving unit begins to move the printed adhesive film in the direction of the cutting apparatus. In this way, it is possible to prevent the first moving unit from already trying to move the printed adhesive film to the second moving unit, for example, even though the adhesive film has not yet been cut and the printer has not yet released the printed adhesive film. The printed adhesive film can be prevented, for example, from moving inadvertently and in particular from being twisted, which could ultimately result in the printed adhesive film being imprecisely aligned within the cutting apparatus and thus in the cutting operation being less accurate.

The printer and the transferring apparatus are preferably adapted in such a way that the printed adhesive film fed to the transferring apparatus from the printer rotates the freewheeling rolls of the first moving unit, wherein the adhesive film detection unit is adapted to detect when the adhesive film is fed, by detecting the rotation of the rolls of the first moving unit. This passive rotation of the freewheeling rolls can additionally be used, in particular, to measure the distance that the printed adhesive film has been guided into the transferring apparatus by the printer. The rolls of the first moving unit may thus be used for different purposes, thus allowing the device to be very compact in design.

The printer is preferably a dye-sublimation thermal printer, and the printing pattern is preferably a color and/or black and white and/or grayscale pattern. The input device preferably comprises a photo data receiving unit, said photo data receiving unit being adapted to receive the user's photo data as user input. The input device is preferably also adapted to show the user different pattern templates and to allow the user to select a pattern template as user input. The input device is preferably also adapted to allow a user to select a product, in particular a product bought in a self-service area of a drug store, wherein the input device can be further adapted to select a pattern template on the basis of the selected product and on the basis of predefined allocations between products and patterns, and to provide the selected pattern template as user input. More particularly, the products may be marked with a product code, and the input device may comprise a product code reader for reading a product code of a product selected by the user. The product code can be a barcode, for example, and the product code reader can be a unit for reading a barcode. The input device can also be adapted to allow the user to enter inputs which modify the selected pattern template, for example the user can enter a text and/or a color to be added to the pattern. The photo data can also be added to the pattern.

The goal specified above is also achieved by a method for producing adhesive labels, said method comprising the following steps:

allowing the user to enter inputs using an input device, generating a pattern by means of a pattern generating means on the basis of the user inputs, wherein the pattern comprises a cutting pattern and a printing pattern within the cutting pattern, printing the printing pattern onto an adhesive film by means of a printer, automatically transferring the printed adhesive film from the printer to a cutting apparatus using a transferring apparatus, wherein a first moving unit of the transferring apparatus automatically moves the printed adhesive film in a forward direction from the printer to the cutting apparatus, wherein the automatic transfer of the printed adhesive film from the printer to the cutting apparatus is controlled by a control apparatus, and cutting the adhesive film along the cutting pattern by means of the cutting apparatus.

The goal specified above is also achieved by a computer program for producing adhesive labels, wherein the computer program contains program code which is adapted to control a device for producing adhesive labels as described herein in such a way that the herein-described method for producing adhesive labels is carried out when the computer program is executed on a control apparatus which controls the device.

It should be understood that the herein-described device, method and computer program have similar and/or identical preferred embodiments, as defined in particular in the dependent claims.

Figure 2:
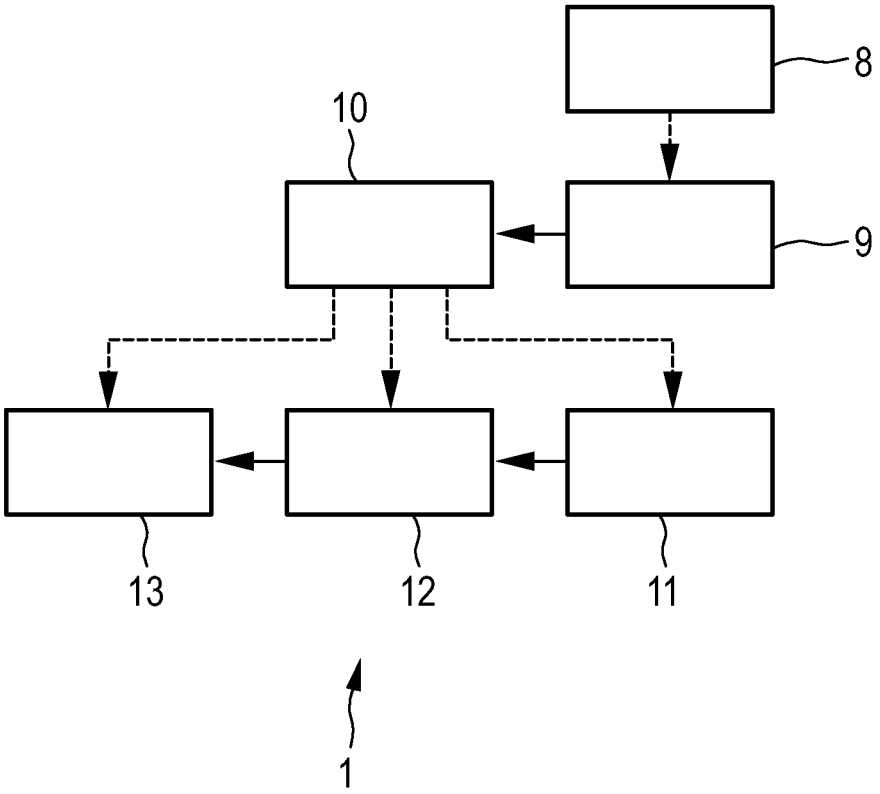
FIG. 2 shows, in schematic form and by way of example, some components of the device shown in FIG. 1.
Figure 3:
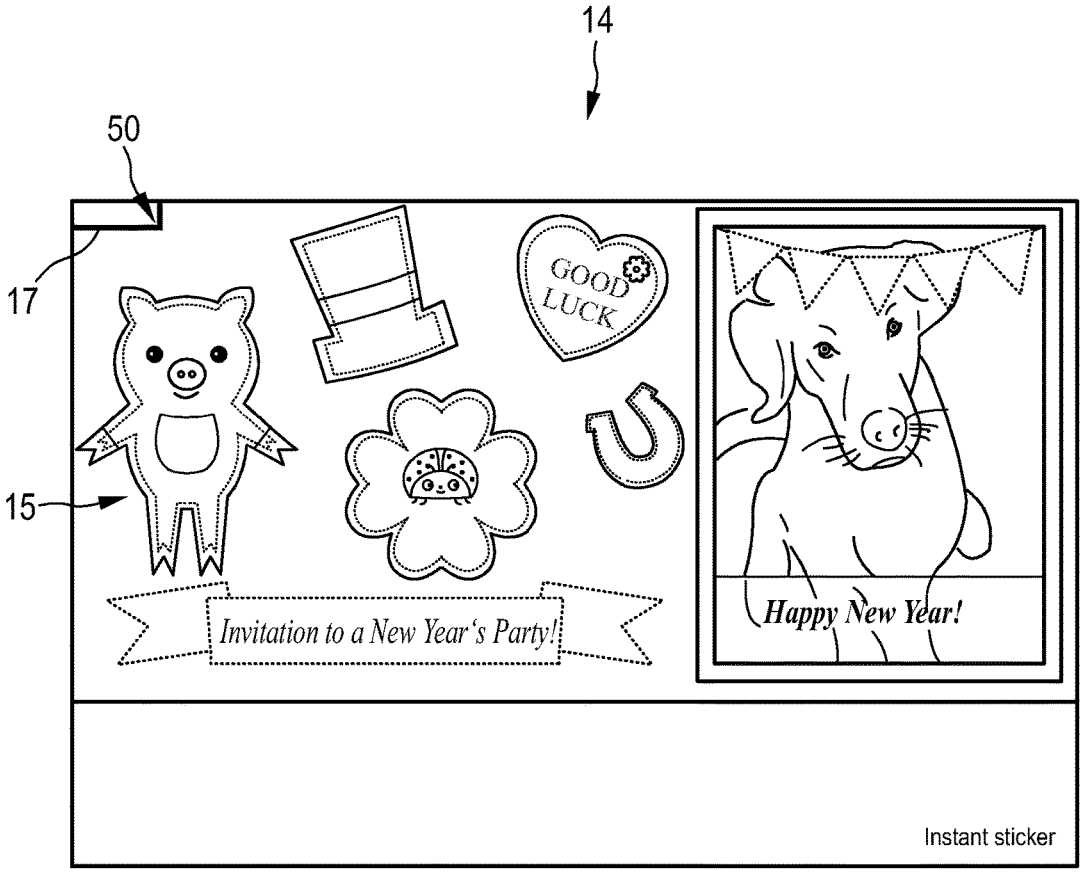
FIG. 3 shows, in schematic form and by way of example, a printed and cut adhesive film containing several adhesive labels thus produced.

FIG. 1 shows, in schematic form and by of example, an embodiment of a device for producing adhesive labels. In this example, device 1 is in a self-service area of a drug store. Device 1 comprises a touch-sensitive monitor 3, a photo data receiving unit 5 and a product code reader 6 in a housing 2. Touch-sensitive monitor 3, photo data receiving unit 5 and product code reader 6 may be conceived of as components of an input device 8 which is adapted to allow a user to enter inputs. Inside housing 2, there is also a pattern generating means 9 for generating a pattern 15 on the basis of the user inputs, wherein pattern 15 comprises a cutting pattern and a printing pattern within the cutting pattern. FIG. 2 illustrates, in schematic form and by way of example, the pattern generating means 9 and other components of device 1 that are located inside housing 2. FIG. 3 shows an example of a printed and cut adhesive film 14 containing several patterns 15.

Photo data receiving unit 5 is adapted to receive the user's photo data as user inputs. The user can also select a product that is obtainable in the self-service area of the drug store and hold it up to product code reader 6 so that a product code applied to the product can be read by product code reader 6. The product code can be a barcode, for example, and product code reader 6 can be a unit for reading a barcode. Input device 8 can also have allocations between products or product codes, on the one hand, and pattern templates, on the other hand, and one or more pattern templates can be shown on touch-sensitive monitor 3 on the basis of these allocations and the product code which is read from the product selected by the user. When several pattern templates are displayed on touch-sensitive monitor 3, the user can select one of them. Input device 8 can also be adapted to allow the user to enter desired changes, for example a desired text, a desired color, etc. On the basis of those user inputs, pattern generating means 9 can generate the pattern.

Device 1 further comprises a printer 11 for printing a printing pattern onto an adhesive film 14, a cutting apparatus 13 for cutting adhesive film 14 along a cutting pattern, and a transferring apparatus 12 for automatically transferring printed adhesive film 14 from printer 11 to cutting apparatus 13, wherein transferring apparatus 12 comprises a first moving unit 16 for automatically moving printed adhesive film 14 in a forward direction from printer 11 to cutting apparatus 13. Device 1 further comprises a control apparatus 10 which is adapted to control the automatic transfer of printed adhesive film 14 from printer 11 to cutting apparatus 13.

The printing pattern is preferably a color and/or black and white and/or grayscale pattern. In this embodiment, printer 11 is a dye-sublimation thermal printer. Dye-sublimation thermal printer 11 is adapted to print the printing pattern onto a printed area of an adhesive film, to cut out said printed area and to feed the cut-out printed area as a printed adhesive film 14 to transferring apparatus 12. Printed adhesive film 14 is therefore the same as the respective printed area on the adhesive film. Dye-sublimation thermal printer 11 is the Citizen CX/DS40 printer, for example, or some other dye-sublimation thermal printer.

Printer 11, transferring apparatus 12 and cutting apparatus 13 are arranged in such a way that adhesive film 14 can be moved linearly in a forward direction from printer 11 to cutting apparatus 13 via transferring apparatus 12, transferring apparatus 12 being adapted to move printed adhesive film 14 in a forward direction by performing a translational movement only, without rotating adhesive film 14. The adhesive film 14 printed by printer 11 and cut by cutting apparatus 13 is guided out of housing 2 through an output slot 7.

Figure 4:
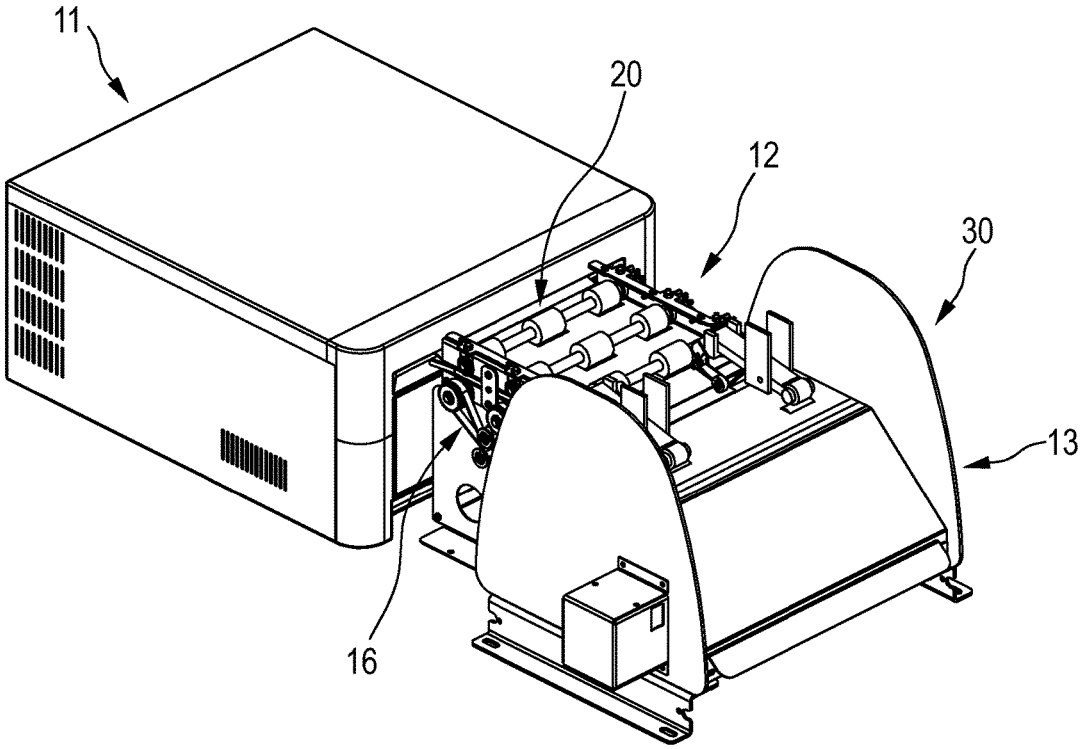
FIGS. 4-7 shows, in schematic form and by way of example, different views of a combination of printer, transferring apparatus and cutting apparatus of the device shown in FIG. 1.
Figure 5:
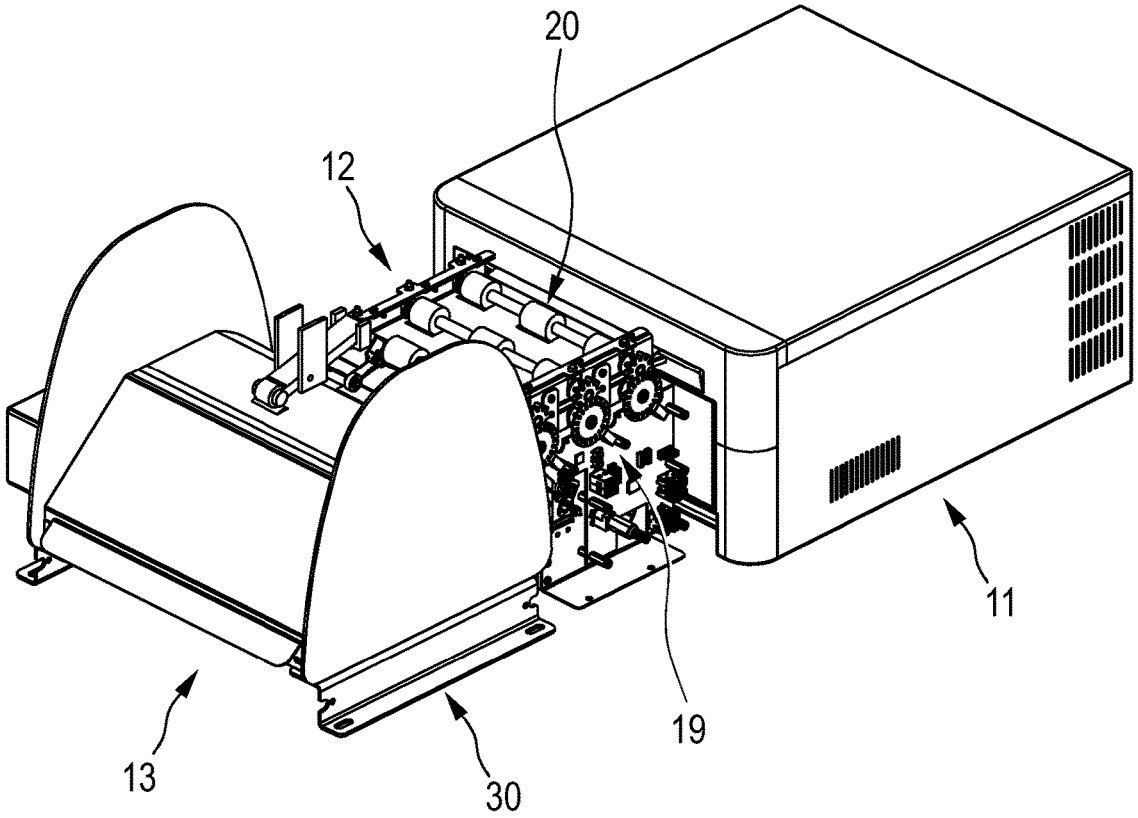
Figure 6:
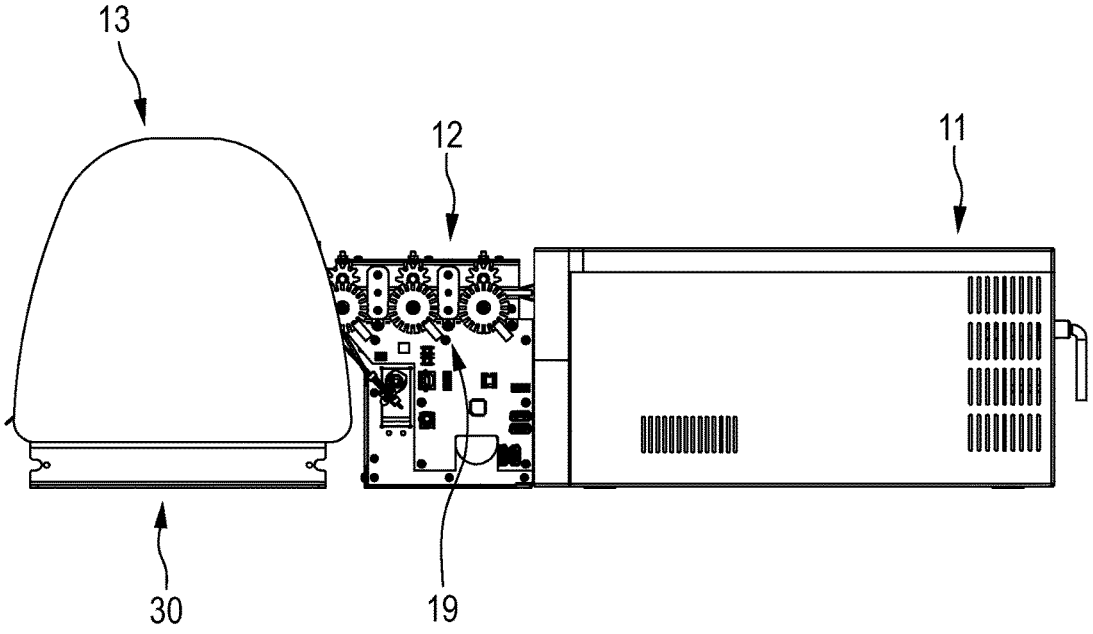
Figure 7:
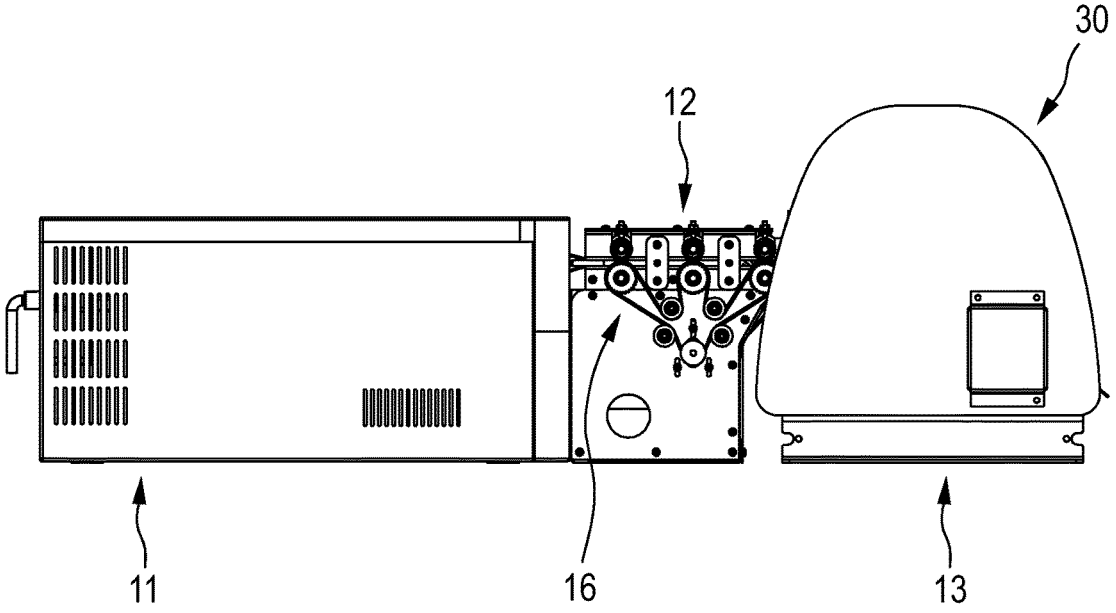
Figure 8:
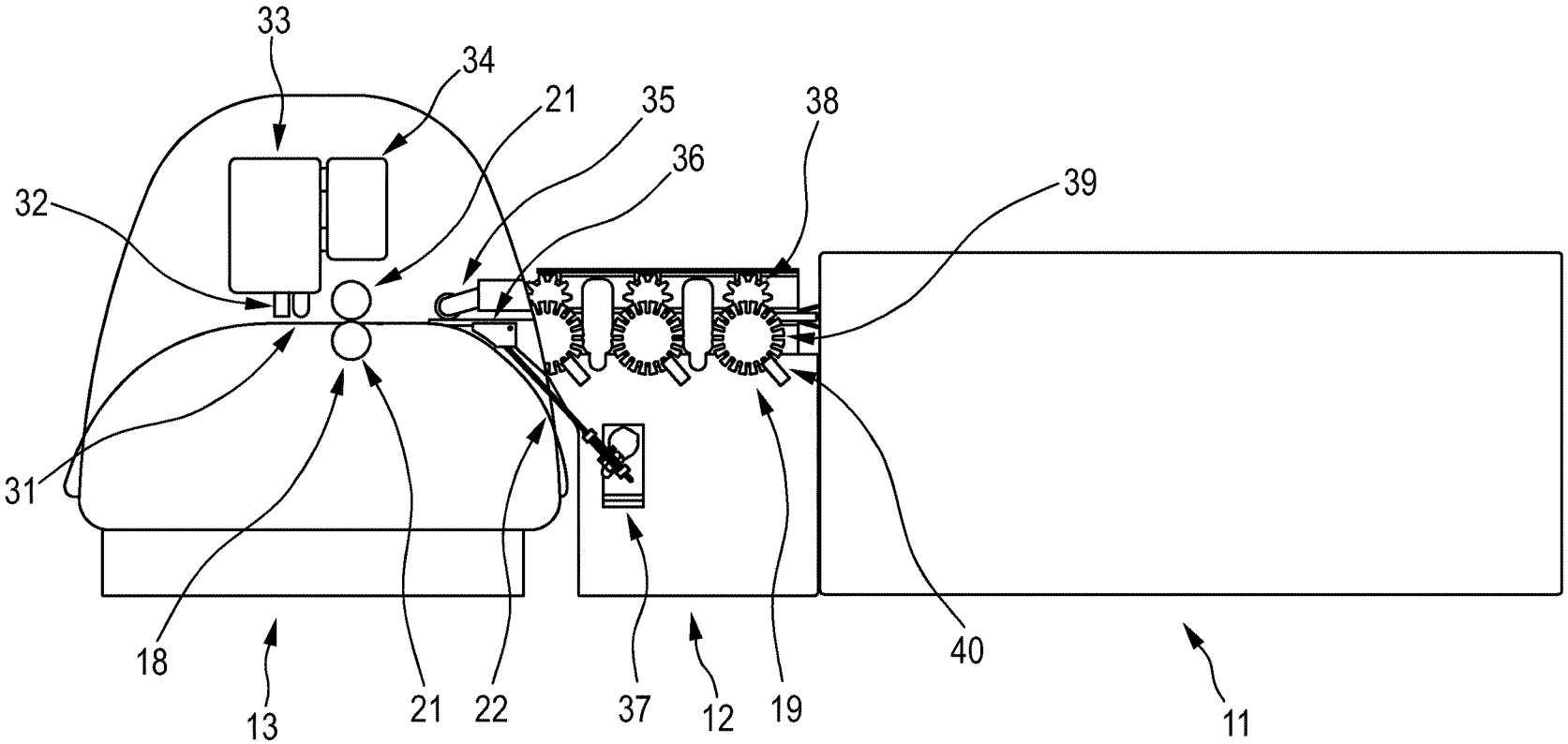
FIG. 8 shows, in schematic form and by way of example, an abstract representation of the combination shown in FIGS. 4 to 7.

In the following, details of printer 11, transferring apparatus 12 and cutting apparatus 13 shall be described with reference to FIGS. 4 to 8, in which FIGS. 4 and 5 show top views from an angle and FIGS. 6 and 7 show side views. FIG. 8 is an abstract representation that also shows elements of cutting apparatus 13 that are not visible in FIGS. 4 to 7 because they are arranged inside a housing 30.

The first moving unit 16 of transferring apparatus 12 comprises a plurality of rolls 20 arranged on axles, the axles being driven via a belt by means of a motor. At least those rolls 20 which are arranged on the axle closest to printer 11 can freewheel in the direction of forward motion of printed adhesive film 14. One end of each of the axles of the first moving unit 16, on which rolls 20 are arranged, has a sprocket 38 which engages with another sprocket 39 so that sprocket 39 turns when the axles and thus rolls 20 are driven by the motor of the first moving unit 16. Sprocket 39 turns even when the axles of the first moving unit 16 with rolls 20 are not driven motorically, but when said axles rotate due to printed adhesive film 14 being moved from the printer 11 into transferring apparatus 12.

The first moving unit 16 further comprises a sensor 40 consisting, for example, of a combination of a light source and a light detector, the light source and the light detector being arranged in such a way that the number of teeth on sprocket 39 that are moved past sensor 40 can be counted. Based on the number of teeth of sprocket 39 that are moved past the sensor, it is possible for control apparatus 10 to determine by how many degrees sprocket 39 has been turned. This can be used to measure the distance by which printed adhesive film 14 has been moved through printer 11 into transferring apparatus 12 and also by means of the first moving unit 16 in the direction of cutting unit 13.

Detection of any rotation of sprocket 39, which is arranged closest to printer 11, can be used to establish whether printed adhesive film 14 has been fed into transferring apparatus 12. The combination of sprockets 38, 39 and sensor 40 can therefore be conceived of as an adhesive film detection unit 19 for detecting when printed adhesive film 14 is fed to transferring apparatus 12. Since the combination of sprockets 38, 39 and der 40 is also used to measure the distance by which the printer 11 has guided printed adhesive film 14 into transferring apparatus 12 and by which the first moving unit 16 has moved printed adhesive film 14 in the direction of cutting apparatus 13, this combination can also be conceived of as a measurement unit 19 for measuring said distances.

The first moving unit 16 is preferably controlled in such a way that the first moving unit 16 does not move printed adhesive film 14 in the direction of the cutting apparatus 13 until a predefined period of time has expired since detection of the adhesive film 14 being fed. The predefined period of time is preferably at least so long that the cutting operation of printer 11 is completed when the first moving unit 16 begins to move printed adhesive film 14 in the direction of cutting apparatus 13.

Control apparatus 10 is preferably adapted so that the first moving unit 16 moves printed adhesive film 14 forward in the direction of cutting apparatus 13 until the measured distance indicates that printed adhesive film 14 has been moved to a second moving unit 18 of cutting apparatus 13. The first moving unit 16 is specifically controlled so that printed adhesive film 14 is moved forward in the direction of cutting apparatus 13 until the measured distance indicates that printed adhesive film 14 is arranged just in front of rolls 21 of the second moving unit 18. The rolls 21 of the second moving unit 18 are motor-driven and do not freewheel. They can be rotated in such a way that printed adhesive film 14 can be moved in a forward direction and in a backward direction inside cutting apparatus 13.

The first and the second moving units 16, 18 are preferably controlled in such a way that only the first moving unit 16 is initially activated to move printed adhesive film 14 to the second moving unit 18, wherein both moving units 16, 18 are then activated in such a way that the two moving units 16, 18 move printed adhesive film 14 synchronously further into cutting apparatus 13. When printed adhesive film 14 has been moved into cutting apparatus 13 and has left transferring apparatus 12, a guide unit 22 of transferring apparatus 12 is actuated so that printed adhesive film 14 is moved past the first moving unit 16 when printed adhesive film 14 is moved backward again from the second moving unit 18 of cutting apparatus 13. More particularly, guide unit 22 can be adjusted so that printed adhesive film 14 is guided underneath the first moving unit 16 when the second moving unit 18 moves printed adhesive film 14 backward in the direction of transferring apparatus 12. In this embodiment, guide unit 22 includes a guide 36 and a servodrive 37, said servodrive 37 being controlled in such a way that guide 36, which is formed by a sheet of metal, for example, is raised to guide printed adhesive film 14 past the first moving unit 16 when printed adhesive film 14 is moved backward from cutting apparatus 13.

When the adhesive film 14 is moving from transferring apparatus 12 to cutting apparatus 13, a pressure roll 35 can be used to hold adhesive film 14 down, wherein said pressure roll 35 can be designed in such a way that pressure roll 35 is pivoted upwards when servodrive 37 raises guide 36.

Printed adhesive film 14 has an orientation marking 17 which was printed onto adhesive film 14 by printer 11. Cutting apparatus 13 includes a detection unit 32 for detecting the orientation marking on printed adhesive film 14, said cutting apparatus 13 being adapted to optimize the orientation of printed adhesive film 14 inside cutting apparatus 13, on the basis of the detected orientation marking 17, before cutting is carried out. More particularly, the second moving unit 18 for moving printed adhesive film 14 in a forward and a backward direction inside cutting apparatus 13, and a cutting unit 31 of cutting apparatus 13, which can be moved orthogonally in relation thereto, can be controlled in such a way that, before cutting is carried out, the position of the cutting unit relative to the orientation marking corresponds very accurately to a predefined position.

In this embodiment, both cutting unit 31 and detection unit 32 are mounted on a same head 33 of cutting apparatus 13, wherein said head 33 can be moved orthogonally to the forward and the backward direction along an axis 34 by means of a motor. The second moving unit 18 moves printed adhesive film 14, and head 33 moves detection unit 32 in such a way that detection unit 32 is arranged above the inside corner 50 of orientation marking 17. Detection unit 32, in particular, includes a light source, for example a laser, and a light detector, for example a photodiode, wherein the second moving unit 18 moves printed adhesive film 14 in such a way, and head 33 with detection unit 32 is moved in such a way, that a beam of light emitted from the light source of detection unit 32 strikes the inside corner inside corner 50 of orientation marking 17. When this state is reached, cutting unit 31 has a defined, very exact orientation relative to printed adhesive film 14, in particular to the printing pattern. After that, cutting apparatus 13 is controlled so that adhesive film 14 is cut along the cutting pattern of the respective pattern 15, adhesive film 14 being on a substrate, in particular on a paper substrate or on some other substrate medium, and cutting apparatus 13 is preferably adapted to cut through only adhesive film 14, but not the substrate underneath it. The adhesive labels produced by printing and cutting can then be outputted through output slot 7. The customer can pull an adhesive label from the adhesive film 14 that has been printed and cut and can stick the label onto the desired product.

Figure 9:
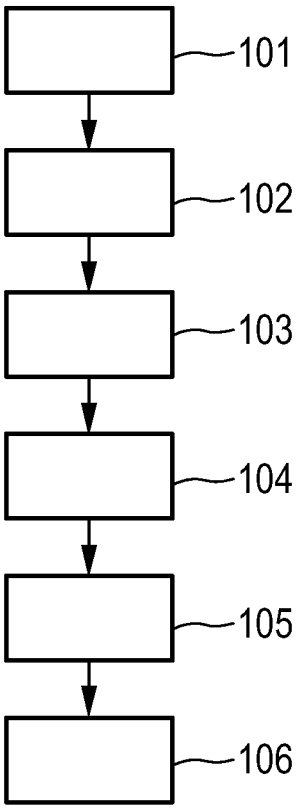
FIG. 9 shows a flow diagram illustrating an embodiment of a method for producing adhesive labels.

An embodiment of a method for producing adhesive labels, in particular in a self-service area, for example of a drug store, shall now be described with reference to a flow diagram shown in FIG. 9.

In step 101, a customer can enter inputs to input device 8. For example, the customer can enter photo data, texts, desired colors, etc. The customer can also select a desired pattern template from a number of such pattern templates, for example. This selection can also be made by selecting a product, with the customer firstly selecting a product, after which the customer can be shown one or more pattern templates that match the selected product. If the customer is shown several pattern templates, the customer can select one of those pattern templates by means of input device 8.

In step 102, a pattern is generated by pattern generating means 9 on the basis of the customer inputs, said pattern comprising a cutting pattern and a printing pattern within the cutting pattern. For example, a photo of the customer, included in the photo data, is integrated into a pattern template, and the pattern template can also be modified with colors and/or text entered by the customer in step 101. The pattern generated in this manner, that is the printing pattern at least, is sent to printer 11, which prints the printing pattern onto the adhesive film in step 103.

In step 104, the printed adhesive film is transferred automatically from printer 11 to cutting apparatus 13 by means of transferring apparatus 12, and the first moving unit 16 of transferring apparatus 12 moves the printed adhesive film automatically in the forward direction from printer 11 to cutting apparatus 13. In step 105, cutting apparatus 13 cuts the adhesive film along the cutting pattern to produce the adhesive labels, and in step 106 the adhesive labels thus produced are outputted through output slot 7.

Input device 8 preferably provides a graphical user interface, which can be operated by the customer by means of touch-sensitive monitor 3, for selecting desired colors, desired pattern templates, etc., and for entering desired texts. The adhesive label thus produced may be an adhesive label to be stuck onto a product to be bought, for example a shower gel container, muesli packaging, etc., in which case an adhesive label is produced which is suitable for the respective product, that is, for the respective product packaging. However, device 1 may also be adapted to produce adhesive labels which are not specifically matched to particular products or product containers. This means that device 1 may also be adapted to produce adhesive labels which are independent of specific products and which can be stuck onto cars or other objects, for example.

Device 1 allows personalized adhesive labels to be produced, that is, adhesive labels which have been designed by means of customer inputs. In the embodiment described with reference to FIGS. 1 to 8, photo data receiving unit 5 is adapted to read photo data by means of a storage medium, for example, a USB flash drive. In other embodiments, however, the photo data receiving unit may also be adapted to receive the photo data in some another manner. For example, the photo data may be received directly from a camera via a wired or wireless data connection, in particular from a smartphone with a photo function. The photo data receiving unit may also be adapted to receive the photo data via cloud services such as Facebook, Dropbox, CEWE Cloud, etc.

The printer, which is preferably a dye-sublimation thermal printer, prints the respective pattern onto an adhesive film which is disposed on a substrate medium, for example a paper substrate, after which the printed adhesive film is transferred by means of the transferring apparatus to the cutting apparatus, which can also be conceived of as a sticker cutter. The orientation marking put on the adhesive film is detected by sensors, that is, by the detection unit of the cutting apparatus, and is used for re-adjusting the adhesive film, that is, for vertical and horizontal alignment of the adhesive film. In addition to the printed adhesive film, a digital clipping mask, that is, the cutting pattern, is sent to the cutting apparatus, said digital clipping mask representing the outlines of the adhesive label. The cutting unit of the cutting apparatus preferably comprises a drag knife, which is moved along the outline of the adhesive label, that is, along the cutting pattern, in order to cut into the adhesive film along the cutting pattern. The drag knife is preferably moved in such a way that only the adhesive film is incised, but not the substrate medium.

The cutting apparatus may be adapted to cut out any cutting patterns that are offered to the customer in the form of templates, that is, in the form of the pattern templates, with the customer being able to select any one of those templates. After cutting, the cutting apparatus outputs the adhesive label that has finally been produced. The adhesive label can be pulled off the substrate material by the customer without any residue being left. If the customer selected a product to which he would like to apply the adhesive label, the latter can now be stuck on by the customer himself. Products obtainable in the drug store can thus be personalized in a simple manner by the customer himself.

In the claims, the words "comprise" and "include" do not exclude other elements or steps, and the indefinite article "a/an" does not exclude a plurality.

A single unit or device may perform the functions of several elements mentioned in the claims. The fact that individual functions and elements are mentioned in different dependent claims does not mean that a combination of these functions or elements could not also be used to advantage.

The controller of the device for producing adhesive labels in accordance with the method for producing adhesive labels can be implemented as computer program code and/or in the form of appropriate hardware and in particular is a programmable logic controller (PLC).

A computer program can be stored and/or distributed on a suitable non-transitory medium, for example on an optical storage medium or a solid-state storage medium which is operated in combination with or as part of other hardware. However, the computer program can also be distributed in other forms, for example via the Internet or other telecommunications systems.

The embodiments described herein relate to a device for producing adhesive labels, in particular in a self-service area, for example of a drug store. The device comprises a printer for printing a printing pattern based on user inputs onto an adhesive film, a cutting apparatus for cutting the adhesive film along a specified cutting pattern which can be selected by a user, and a transferring apparatus for automatically transferring the printed adhesive film from the printer to the cutting apparatus, wherein the transferring apparatus comprises a first moving unit for automatically moving the printed adhesive film in a forward direction from the printer to the cutting apparatus. A control apparatus controls the automatic transfer of the printed adhesive film from the printer to the cutting apparatus.

The invention claimed is:

1. A device for producing adhesive labels, wherein the device comprises:

an input device which is adapted to allow a user to enter inputs;

a pattern generating means for generating a pattern on the basis of the user inputs, wherein the pattern comprises a cutting pattern and a printing pattern within the cutting pattern;

a printer for printing the printing pattern onto an adhesive film;

a cutting apparatus for cutting the adhesive film along the cutting pattern;

a transferring apparatus for automatically transferring the printed adhesive film from the printer to the cutting apparatus, wherein the transferring apparatus comprises a first moving unit for automatically moving the printed adhesive film in a forward direction from the printer to the cutting apparatus; and a control apparatus for controlling the automatic transfer of the printed adhesive film from the printer to the cutting apparatus, wherein the cutting apparatus has a second moving unit for moving the printed adhesive film inside the cutting apparatus, wherein the second moving unit is adapted to move the printed adhesive film in the cutting apparatus in a forward and a backward direction.

2. The device according to claim 1, wherein the printer, the transferring apparatus and the cutting apparatus are arranged in such a way that the adhesive film can be moved linearly in a forward direction from the printer to the cutting apparatus via the transferring apparatus, wherein the transferring apparatus is adapted to move the printed adhesive film in a forward direction by performing a translational movement only, without rotating the adhesive film.

3. The device according to claim 1, wherein the control apparatus is adapted to control the first and the second moving units in such a way that only the first moving unit is initially activated to move the printed adhesive film to the second moving unit, wherein both moving units are then activated in such a way that the two moving units move the printed adhesive film synchronously further into the cutting apparatus.

4. The device according to claim 3, wherein the transferring apparatus further comprises a measurement unit for measuring the distance the printed adhesive film is moved in the direction of the cutting apparatus by means of the first moving unit, wherein the control apparatus is adapted to control the first moving unit in such a way that the printed adhesive film is moved forward in the direction of the cutting apparatus until the measured distance indicates that the printed adhesive film has been moved to the second moving unit.

5. The device according to claim 4, wherein the measurement unit is also adapted to measure the distance that the printer has guided the printed adhesive film into the transferring apparatus, wherein the control apparatus is adapted to control the first moving unit in such a way that the printed adhesive film is moved forward in the direction of the cutting apparatus until the total measured distance indicates that the printed adhesive film has been moved to the second moving unit.

6. The device according to claim 5, wherein the first moving unit has motor-driven rolls that freewheel in a forward direction, wherein the measurement unit is adapted to measure a passive freewheeling rotation of the rolls when the printed adhesive film is moved from the printer into the transferring apparatus, in order to measure the distance that the printer has moved the printed adhesive film into the transferring apparatus.

7. The device according to claim 1, wherein the second moving unit comprises motor-driven rolls for moving the printed adhesive film in the cutting apparatus, wherein the motor-driven rolls do not freewheel.

8. The device according to claim 1, wherein the transferring apparatus comprises a guide unit which is adjusted to guide the printed adhesive film past the first moving unit when the second moving unit moves the printed adhesive film backward in the direction of the transferring apparatus.

9. The device according to claim 8, wherein the guide unit is adjusted to guide the printed adhesive film underneath the first moving unit when the second moving unit moves the printed adhesive film backward in the direction of the transferring apparatus.

10. The device according to claim 1, wherein the transferring apparatus has an adhesive film detection unit for detecting when the printed adhesive film is fed to the transferring apparatus, wherein the control apparatus is adapted to control the first moving unit in such a way that the first moving unit does not move the printed adhesive film in the direction of the cutting apparatus until a predefined period of time has expired since detection of the adhesive film being fed.

11. The device according to claim 1, wherein the first moving unit comprises motor-driven rolls for moving the printed adhesive film and which freewheel in the direction of the cutting apparatus.

12. The device according to claim 11, wherein the printer and the transferring apparatus are adapted in such a way that the printed adhesive film fed to the transferring apparatus from the printer rotates the freewheeling rolls of the first moving unit, wherein the adhesive film detection unit is adapted to detect when the adhesive film is fed, by detecting the rotation of the rolls of the first moving unit.

13. A method for producing adhesive labels, wherein the method comprises the steps of:

allowing a user to enter inputs using an input device, generating a pattern by means of a pattern generating means on the basis of the user inputs, wherein the pattern comprises a cutting pattern and a printing pattern within the cutting pattern, printing the printing pattern onto an adhesive film by means of a printer, automatically transferring the printed adhesive film from the printer to a cutting apparatus using a transferring apparatus, wherein a first moving unit of the transferring apparatus automatically moves the printed adhesive film in a forward direction from the printer to the cutting apparatus, wherein the automatic transfer of the printed adhesive film from the printer to the cutting apparatus is controlled by a control apparatus, and cutting the adhesive film along the cutting pattern by means of the cutting apparatus, wherein the cutting apparatus has a second moving unit for moving the printed adhesive film inside the cutting apparatus, wherein the second moving unit moves the printed adhesive film in the cutting apparatus in a forward and a backward direction.

14. A non-transitory storage medium that stores a computer program for producing adhesive labels, wherein the computer program contains program code which is adapted to control a device for producing adhesive labels according to claim 1 in such a way that a method for producing adhesive labels is carried out when the computer program is executed on a control apparatus which controls the device, wherein the method comprises the steps of:

allowing a user to enter inputs using an input device;

generating a pattern by means of a pattern generating means on the basis of the user inputs, wherein the pattern comprises a cutting pattern and a printing pattern within the cutting pattern;

printing the printing pattern onto an adhesive film by means of a printer;

automatically transferring the printed adhesive film from the printer to a cutting apparatus using a transferring apparatus, wherein a first moving unit of the transferring apparatus automatically moves the printed adhesive film in a forward direction from the printer to the the cutting apparatus is controlled by a control apparatus; and cutting the adhesive film along the cutting pattern by means of the cutting apparatus, wherein the cutting apparatus has a second moving unit for moving the printed adhesive film inside the cutting apparatus, wherein the second moving unit moves the printed adhesive film in the cutting apparatus in a forward and a backward direction.

* * * * *